US005618131A

United States Patent [19]

Weber

[11] Patent Number: 5,618,131

[45] Date of Patent: Apr. 8, 1997

[54] MODIFIED ARTIFICIAL SURFACE AND METHOD AND APPARATUS OF MAKING THE SAME

[76] Inventor: Edward A. Weber, 2613 Sequoia Rd., McHenry, Ill. 60050

[21] Appl. No.: 486,911

[22] Filed: Jun. 7, 1995

[51] Int. Cl.[6] ..... E01C 5/18

[52] U.S. Cl. ..... 404/32; 5/913

[58] Field of Search ..... 404/1, 31, 32, 404/34, 35, 36; 472/92; 5/417, 420, 450, 911, 912, 913

[56] References Cited

U.S. PATENT DOCUMENTS

| | | | |
|---|---|---|---|
| 2,613,398 | 10/1952 | Crowell | 264/517 |
| 3,323,802 | 6/1967 | Riner | 473/159 |
| 3,534,961 | 10/1970 | Jiley | 273/108.21 |
| 3,690,673 | 9/1972 | Occhipinti | 473/160 |
| 3,885,795 | 5/1975 | Brewer | 473/165 |
| 3,892,412 | 7/1975 | Koo | 273/176 H |
| 3,984,595 | 10/1976 | Stephens | 428/35 |
| 4,060,953 | 12/1977 | Milne | 52/42.14 |
| 4,327,046 | 4/1982 | Davis et al. | 264/102 |
| 4,347,213 | 8/1982 | Rodgers, Jr. | 264/510 |
| 4,654,268 | 3/1987 | DeBoel et al. | 428/426 |
| 4,761,257 | 8/1988 | Bunn | 264/46.5 |
| 4,904,430 | 2/1990 | Yamada | 264/102 |
| 5,023,128 | 6/1991 | Fatool | 428/172 |
| 5,037,445 | 8/1991 | Sander et al. | 623/66 |
| 5,079,786 | 1/1992 | Rojas | 5/450 |
| 5,390,926 | 2/1995 | Hanson et al. | 273/178 B |

*Primary Examiner*—Henry A. Bennett
*Assistant Examiner*—Pamela A. O'Connor
*Attorney, Agent, or Firm*—Mathew R. P. Perrone, Jr.

[57] ABSTRACT

An artificial surface having at least one compartment with a filler therein has the filler held in position by a vacuum.

17 Claims, 4 Drawing Sheets

MODIFIED ARTIFICIAL SURFACE AND METHOD AND APPARATUS OF MAKING THE SAME

This invention relates to an artificial surface suitable for contact by a human foot, and more particularly to an artificial surface suitable for contact by a human foot or other body part, the surface having durability and flexibility in order to provide comfort or reduce injury.

BACKGROUND OF THE INVENTION

An artificial surface suitable for contact by a human foot or other body part tends to lack the flexibility of a natural turf or other desired surface. Any activity or occupation, which requires long periods of standing or moving on foot, is enhanced by a reasonable flexibility of the surface. This reasonable flexibility can add to a person's reasonable endurance and minimize injury.

An artificial surface usually lacks the flexibility of a grass covered surface. This lack of flexibility can cause injury even if the contact with the surface is merely walking or standing.

Artificial surfaces, commonly known as artificial turf, are routinely used for playing surfaces on baseball field, a football field, or another playing surface. One difficulty in this artificial turf occurs because of the surface on which the turf must be mounted. This surface lacks the resiliency of grass and can many times cause injury to the players.

Typical injuries caused by an artificial surface occur to a knee or to a toe. There is even a vernacularly named disease call "turf toe", which refers to a big toe injury caused by artificial turf. What is desired is the provision of a surface with the required durability, while adding thereto the necessary flexibility for the surface in order to avoid the damage caused to knees or toes, or to an athlete in general.

Another use of an artificial surface is in the recreational area. A typical recreation surface requiring a variety of surfaces is commonly referred to as miniature golf. This game is typically played with a golf putter and a ball on various holes on a man-made course having various obstacles to add difficulty to the hole.

In order to add a further degree of difficulty to miniature golf, it is preferred for each hole to have a different surface. It is especially desirable if the different can be created without major construction problems.

While a standard golf course provides a highly desirable source of recreation, in dry areas, it is difficult to have a golf course. Water is sometimes a luxury in those areas. It thus becomes impossible to properly water a golf course, and achieve the preferred golf course appearance.

Compensating for the lack of water by an artificial turf surface for a golf course is difficult. Firstly, it is desired that each hole on the golf course be different. Differences are accomplished by varying the length and the terrain. The construction problems for varying the holes, within these parameters, put the idea of artificial turf out of reach for a golf course.

While an artificial surface does not soak, or absorb water, as a grass surface does, it is sometimes difficult to remove the water from the surface. Pushing the water off of the surface is time consuming and difficult. Clearly, a simpler method of removing water from the surface is desired.

It is highly desirable to combine the flexibility and durability of a grass field with the cleaning and drying ability and ease of maintenance of artificial turf. If these two factors can be combined, the advantages of artificial turf become very clear.

Furthermore, it is also desirable to provide the comfort underfoot for a person who must stand for a long period. Standing on a hard surface can induce fatigue. This fatigue can interfere with that person doing the desired work. Reduction of fatigue creates a great advantage.

Whether that person works in factory, a grocery store or other facility which requires a long period of standing, a flexible, durable, easily cleaned surface is also highly desirable. If a surface can provide fatigue reduction for a person with the surface being easily cleaned and having improved durability, great advantages are obtained.

SUMMARY OF THE INVENTION

Among the many objectives of this invention is the provision of a layered, artificial surface containing a filler to provide flexibility with the filler being held in position by a vacuum source.

A further objective of this invention is to provide an artificial turf surface for reducing injuries to an athlete.

A still further objective of this invention is to provide an artificial turf surface, which may have water easily removed therefrom.

Yet a further objective of this invention is to provide an artificial turf surface with an easily varied top surface.

Also an objective of this invention is to provide a artificial turf surface having an easily formed top surface.

Another objective of this invention is to provide an artificial turf surface suitable for use on a golf course.

Still another objective of this invention is to provide a method for making a artificial turf surface.

Yet another objective of this invention is to provide a method for making a artificial turf surface, which is firm, but resilient.

A further objective of this invention is to provide a flexible surface for standing or walking.

A still further objective of this invention is to provide a surface, which may have water easily removed therefrom.

Yet a further objective of this invention is to provide a durable surface with an easily varied top surface.

Also an objective of this invention is to provide a durable surface having an easily formed top surface.

Another objective of this invention is to provide a surface suitable for use in a factory.

Still another objective of this invention is to provide a method for making a surface suitable for use in a factory.

Yet another objective of this invention is to provide a method for making a surface, which is firm and resilient.

A further objective of this invention is to provide a flexible surface for reducing fatigue.

These and other objectives of the invention (which other objectives become clear by consideration of the specification, claims and drawings as a whole) are met by providing a hollow, flexible device having at least one compartment for receiving a filler, with the filler being secured in the compartment in position by vacuum.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
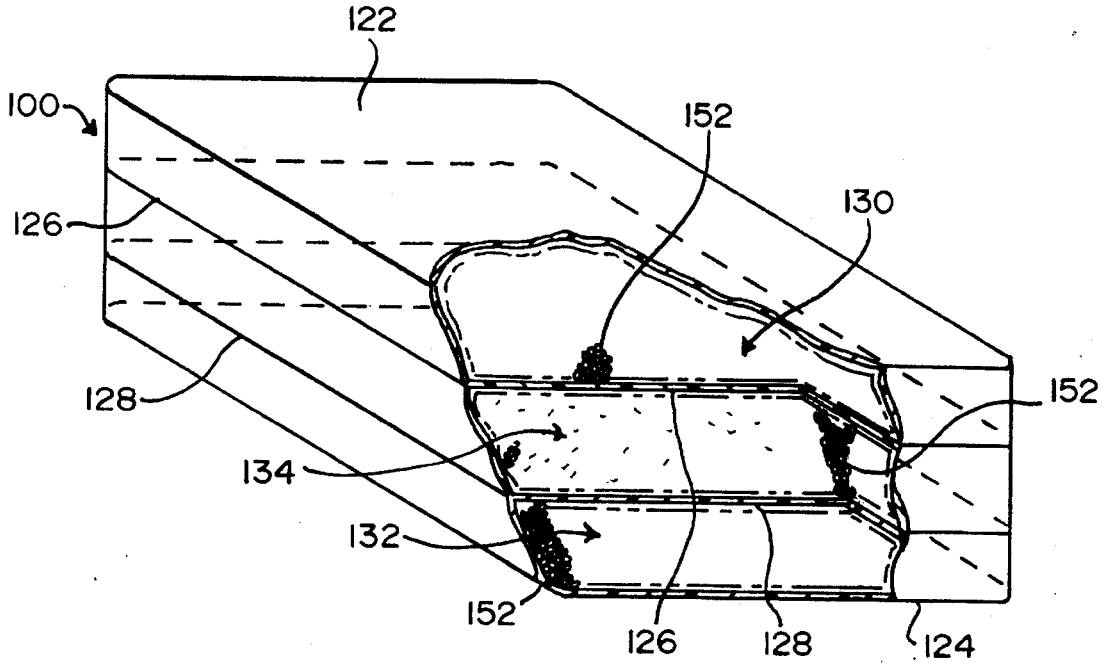
FIG. 1 depicts a perspective partially cutaway view of a plural, compartment-containing device 100 having filler therein.

A device having at least one compartment containing a filler can have the filler placed in a fixed position by the application of a vacuum to the filler-containing compartment. The vacuum supports the filler in a position, while providing flexibility and durability for the outer surface of the compartment.

The contour of the surface of this device can be changed by positioning the filler inside the compartment. Then by application of the vacuum to the compartment, the filler becomes secured in a position to maintain the contour of the surface. The surface can then conform to a desired use for the device. This device can then retain a given surface or have that surface changed when desired.

Very desirably, an advantageous use for this device is an artificial turf having a changeable surface. The artificial turf is secured to a bottom sheet at the edges thereof to form the compartment. An opening to the compartment is achieved by a valve suitable for having a vacuum applied thereto.

Into the compartment is placed a filler. After the vacuum is applied to valve, the filler provides the outer surface with a firm but flexible surface. This feature serves to reduce fatigue.

The contour of the surface of this turf can be changed at will to conform to a desired use. This turf can then retain a given surface or be changed when desired.

A plurality of small compartments can be assembled and placed in a frame. The surface may then be covered as surface. Such a structure, like any structure disclosed herein can be used in the place of employment, any recreational area or other area as desired.

This artificial turf can be used for an in-home putting green for golf. It can also be used for miniature golf and indoor golf. Because of its changeable contour, this turf may also be used to replace artificial turf on football, baseball and soccer fields along with tennis courts, and other athletic fields. It can even be used on golf courses where water use is restricted.

This turf is made from two pieces of a sheet material welded together along the edge of the sheet and filled with pellets of plastic beads or a similar particle. It makes a bag-type container, like a giant, flat bean bag. The size can be made to anyone's specifications with a surface area of up one square mile. A larger surface is usually assembled on site.

Smaller filler container compartments can be framed and positioned as desired. These smaller containers can be assembled on site or off site. If off site is desired, the smaller compartments are easily transported.

With the particles in the compartment, usually in the form of a bag or a container, a desired flexibility is achieved. This flexibility greatly reduces the injuries that can and do result from playing on the standard artificial turf.

This structure can also be used as a floor surface in a factory or other place of business, where standing or being on foot is required. This compartmented structure provides comfort for the worker.

The surface is made firm by applying a vacuum. The pressure can be adjusted from a positive pressure to twenty-nine inches of mercury. The greater the vacuum pressure, the firmer the surface. Therefore, the user of the surface can adjust the firmness of the surface to the required parameters use. When used outside, the vacuum can be reversed to inflate the turf. The turf then assumes a shape which forces the water from a rain to be quickly removed.

The filler may be any suitable particulate filler or bead filler. Preferably, the filler has a diameter of up to about one centimeter. More preferably, the filler has a diameter of about 0.01 to about 0.9 centimeter. Most preferably, the filler has a diameter of about 0.05 to about 0.8 centimeter.

The sheet used herein may be any suitable substantially air impermeable, edge bondable sheet. A rubber sheet is useful. Also a synthetic resin sheet or a plastic sheet is usable.

Considering now FIG. 1, a perspective partially cutaway view of a plural, compartment-containing device 100 having filler 152 therein includes a first outer sheet 122 and a second outer sheet 124. Therebetween is a first interior sheet 126 and a second interior sheet 128. This structure may be used for an athletic surface or a factory floor.

First outer sheet 122 is oppositely disposed from second outer sheet 124, with first interior sheet 126 and a second interior sheet 128 therebetween. All sheets are edge bonded. First outer sheet 122 is adjacent to first interior sheet 126. Second outer sheet 124 is adjacent to second interior sheet 128. First interior sheet 126 is adjacent to second interior sheet 128.

First outer sheet 122 combines with first interior sheet 126 to form first outer pocket 130. Second outer sheet 124 combines with second interior sheet 128 to form second outer pocket 132. First interior sheet 126 combines with second interior sheet 128 to form inner outer pocket 134.

Figure 2:
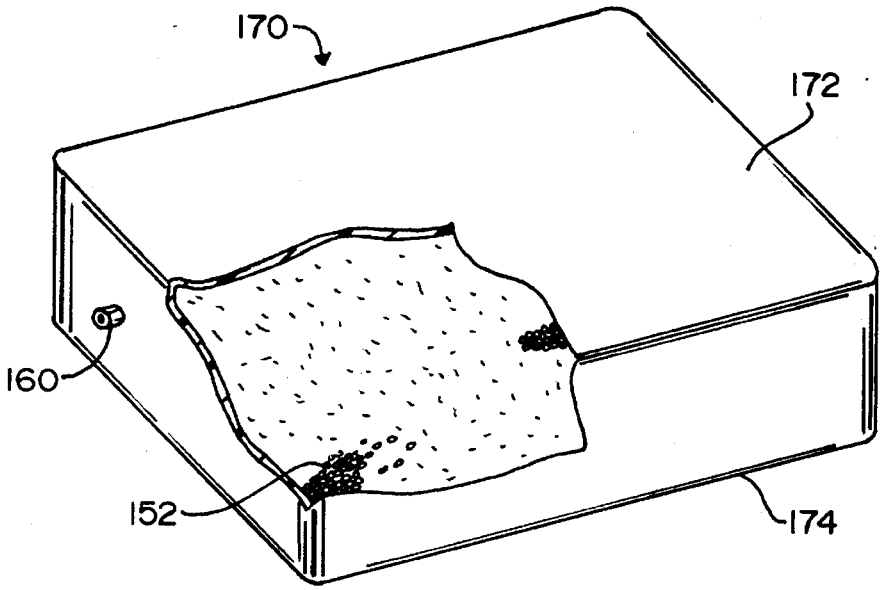
FIG. 2 depicts a perspective partially cutaway view of a single compartment-containing device 100 having filler therein.

With FIG. 2 depicts a perspective partially cutaway view of a single compartment filler-containing device 170 having filler 152 therein. First flexible sheet 172 and second flexible sheet 174 are edge bonded with vacuum valve 160 access for attaching pump 150 thereto. This structure may also be used for an athletic surface or a factory floor.

Figure 3:
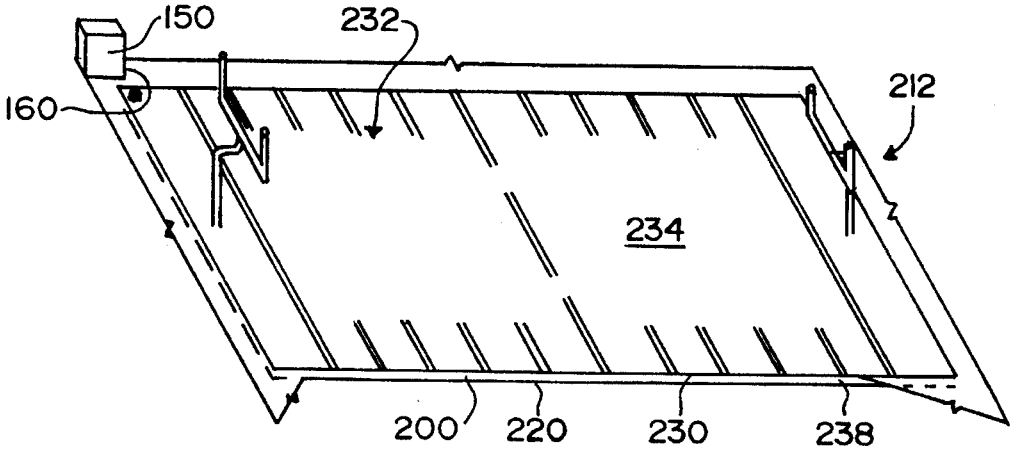
FIG. 3 depicts a perspective, partially cutaway view of an artificial turf surface 200 in the shape of a football field 212.

Referring now to FIG. 3, the artificial turf surface container 200 is depicted. The turf surface container 200 includes a bottom sheet 220 secured to a top sheet 230. The bottom sheet 220 basically has two plain sides. The securing of the bottom sheet 220 to the top sheet 230 may be achieved in any suitable airtight fashion. A securing mechanism is exemplified by sewing, welding, glue, or other suitable mechanism. The artificial turf surface 200 in the shape of a football field 212.

The turf top sheet 230 and the bottom sheet 220 are sufficiently durable material to stand the pounding that any athletic event, such as, in this particular case, a football field 212, can administer to the turf surface.

The top sheet 230 includes a turf surface 232 and a flat surface 234. Flat surface 234 appears on the interior space 238 of the artificial turf surface container 200. The grasslike or artificial turf surface 232 appears on the top thereof and is marked appropriately for a football field 212.

Within the space 238 created between the two sheets, is inserted a durable flexible material such as glass beads 152. The two sheets 220 and 230 are connected to a vacuum pump 150. Pump 150 can withdraw or insert air in between the sheets 220 and 230 to be contained in space 238. As the air is withdrawn, the glass beads 152 between the sheets provide for flexibility of the sheet.

The vacuum valve 160 permits the pump 150 to communicate with interior 238. Thus, the pump 150 can withdraw air from the space 238.

Figure 4:
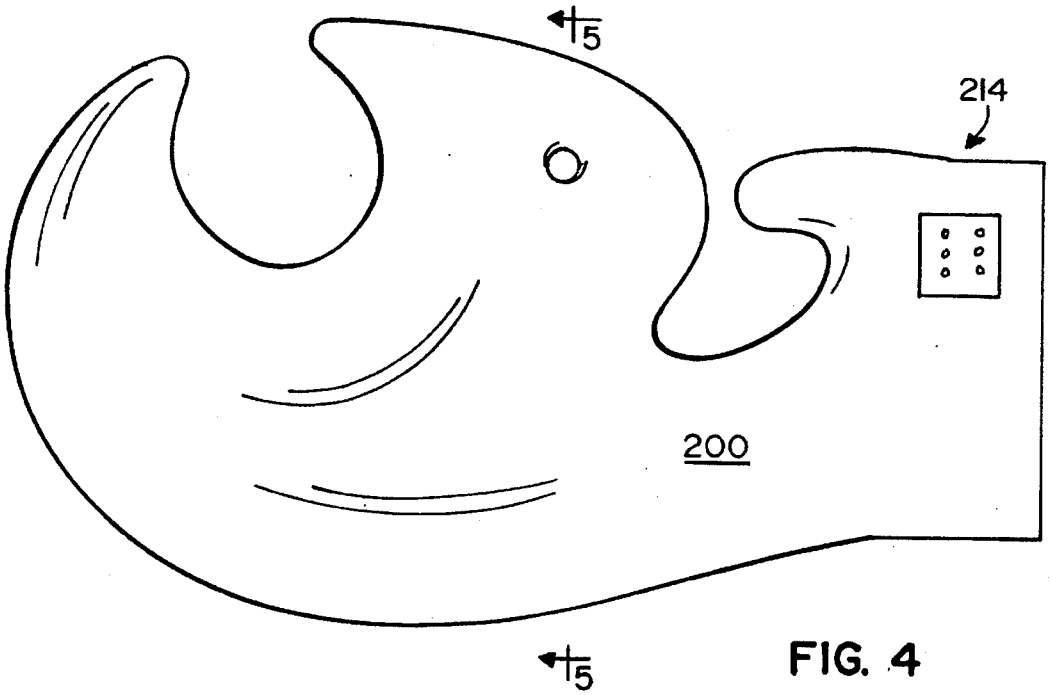
FIG. 4 depicts a top plan view of an artificial turf surface 200 in the shape of a hole for miniature golf 214.
Figure 5:
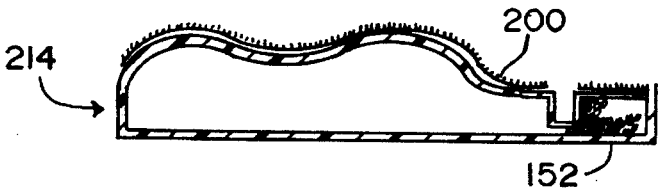
FIG. 5 depicts a side, cross-sectional view of artificial turf surface 200 in the shape of a hole for miniature golf 214 based on FIG. 1.

Referring now to FIG. 4, where the shape of a hole for miniature golf 214 is seen, it is possible to position the glass beads 152 there between the sheets. As the glass beads 152 are positioned, and the vacuum is drawn by pump 150, the glass beads 152 are held into the appropriate position to achieve the desired results of the shape of the hole for miniature golf 214.

Figure 6:
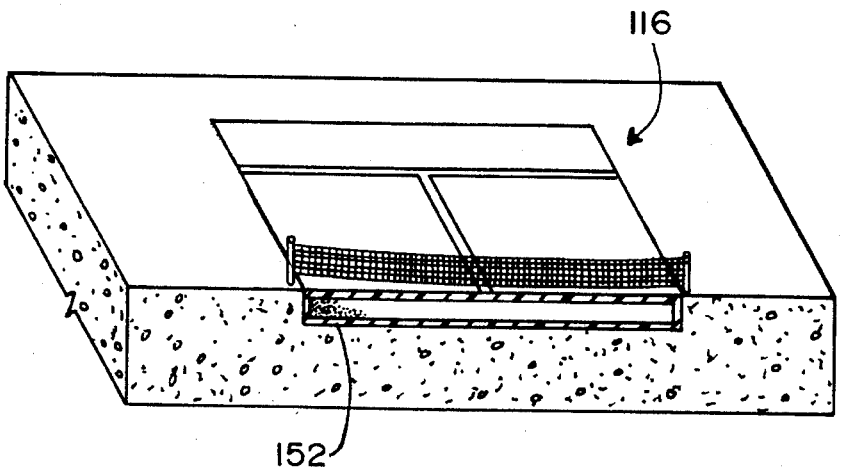
FIG. 6 depicts a perspective partially cutaway view of artificial turf surface 200 in the shape of a tennis court 216.

Referring now to FIG. 6, the artificial turf surface for shape of a tennis court 216 is similar to that of a football filed 212 but varies in size, shape and markings. The tennis court 216 uses the glass beads 152 to create a flat grasslike surface and provide for the flexibility and durability of artificial turf.

Figure 7:
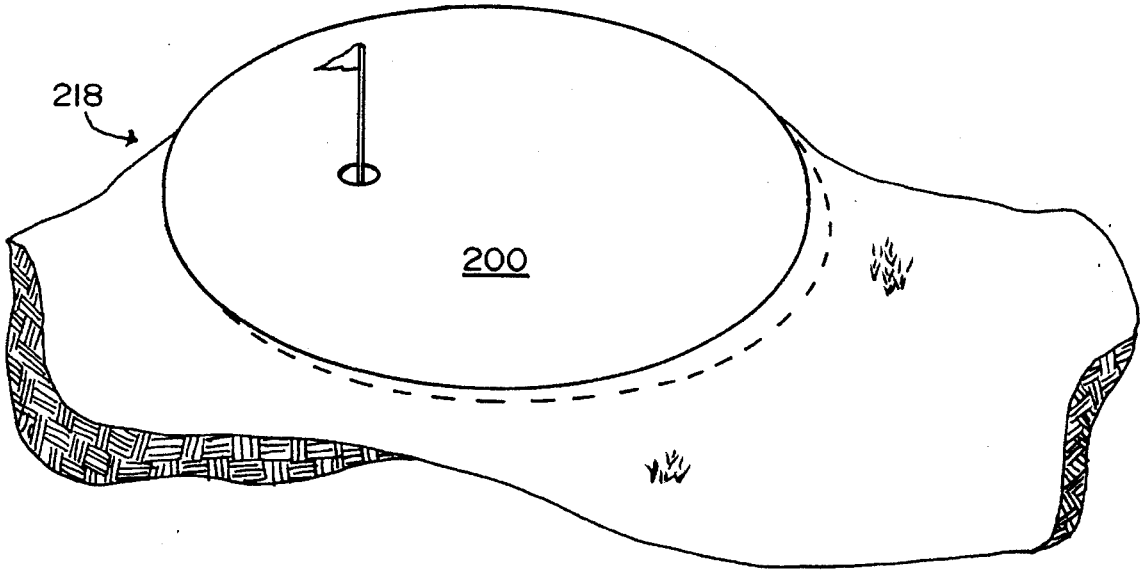
FIG. 7 depicts a perspective partially cutaway view of artificial turf surface 200 in the shape of a hole for standard golf 218.

In FIG. 7, the artificial turf surface depicts a standard golf course 218 which is basically an enlargement of FIG. 4. This artificial turf surface 200 can be made through a plurality of pockets and joining to achieve the desired result. However, with the vacuum aspect of the beads, it is possible to make two big sheets of sufficient size and shape for the golf course. In this fashion, as the beads are shaped, the vacuum can be drawn and the desired results are obtained.

Figure 8:
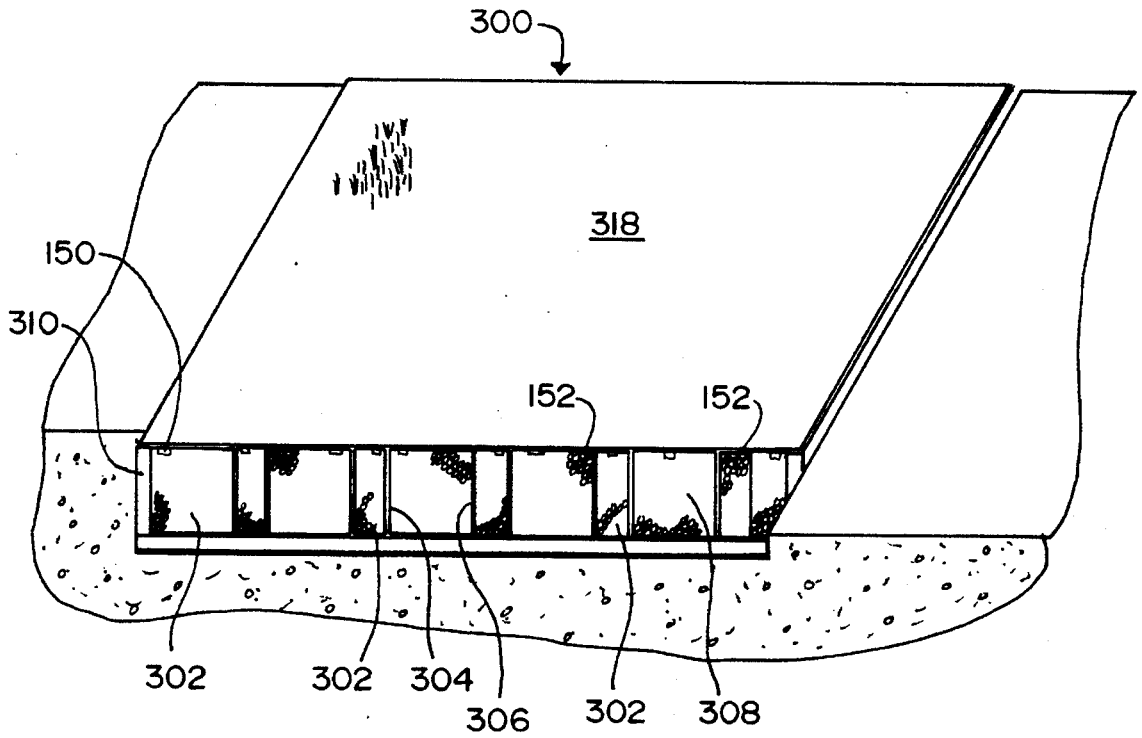
FIG. 8 depicts a perspective partially cutaway view of sheet turf surface 300 supported by a plurality of small filled compartments 302.

FIG. 8 depicts a perspective partially cutaway view of sheet turf surface 300 supported by a plurality of small filled compartments 302. Each filled compartment 302 has a first small sheet 304 edge secured to a second small sheet 306 with a vacuum valve 150 granting access to small interior 308 for filler 152. A plurality of small compartments 302 are mounted in frame 310, which in turn is covered with turf sheet 300. The vacuum applied to each filled compartment 302 determines the flexibility of the surface 318.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. An artificial surface with improved resiliency and reduced injury characteristics comprising:

a) a first sheet of material being secured to a second sheet of material;

b) a compartment being formed between the first sheet of material and the second sheet of material;

c) a filler being contained within the compartment;

d) a valve means communicating with the compartment;

e) a means for positioning the filler within the compartment in order to form the artificial surface;

f) the means for positioning the filler being adaptable to receive a vacuum device removably securable to the valve means;

g) the vacuum device serving to move the first sheet of material in relation to the second sheet of material and to position the filler; and h) the first sheet of material being a top and visible surface of the artificial surface.

2. The artificial surface of claim 1 further comprising the first sheet of material being adapted to have a turf surface.

3. The artificial surface of claim 2 further comprising:

a) a first edge of the first sheet of material being secured to a second edge of the second sheet of material to form the compartment;

b) the valve means further including means to receive a vacuum pump; and c) the artificial surface being adapted for use as a putting green.

4. The artificial surface of claim 2 further comprising:

a) a first edge of the first sheet of material being secured to a second edge of the second sheet of material to form the compartment;

b) the valve means further including means to receive a vacuum pump; and c) the artificial surface being adapted for use as a golf course.

5. The artificial surface of claim 2 further comprising:

a) a first edge of the first sheet of material being secured to a second edge of the second sheet of material to form the compartment;

b) the valve means further including means to receive a vacuum pump; and c) the artificial surface being adapted for use as a miniature golf course.

6. The artificial surface of claim 2 further comprising:

a) a first edge of the first sheet of material being secured to a second edge of the second sheet of material to form the compartment;

b) the valve means further including means to receive a vacuum pump; and c) the artificial surface being adapted for use as a football field.

7. The artificial surface of claim 2 further comprising:

a) a first edge of the first sheet of material being secured to a second edge of the second sheet of material to form the compartment;

b) the valve means further including means to receive a vacuum pump; and c) the artificial surface being adapted for use as a soccer field.

8. The artificial surface of claim 2 further comprising:

a) a first edge of the first sheet of material being secured to a second edge of the second sheet of material to form the compartment;

b) the valve means further including means to receive a vacuum pump; and c) the artificial surface being adapted for use as a factory floor.

9. An artificial surface with improved resiliency and reduced injury characteristics comprising:

a) at least a first compartment and a second compartment being held in position by a frame;

b) the first compartment including a first sheet of material secured to a second sheet of material;

c) the first compartment being formed between the first sheet of material and the second sheet of material;

d) a filler being contained within the first compartment;

e) a valve means communicating with the first compartment;

f) a means for positioning the filler within the compartment in order to form the artificial surface;

g) the first compartment being similar to the second compartment;

h) the means for positioning the filler being adaptable to receive a vacuum device removably securable to the valve means;

i) the vacuum device serving to move the first sheet of material in relation to the second sheet of material and to position the filler; and j) the first sheet of material being a top and visible surface of the artificial surface.

10. The artificial surface of claim 9 further comprising the first sheet of material being adapted for use as a turf surface.

11. The artificial surface of claim 10 further comprising:

a) a first edge of the first sheet of material being secured to a second edge of the second sheet of material to form the compartment being secured to a sheet adapted for use as a turf surface;

b) the valve means further including means to receive a vacuum pump; and c) the artificial surface being adapted for use as a putting green.

12. An artificial surface with improved resiliency and reduced injury characteristics comprising:

a) a first outer sheet of material secured to a second outer sheet of material;

b) at least a first inner sheet of material and a second inner sheet of material secured between the first outer sheet of material and the second outer sheet of material to form at least a first compartment and a second compartment;

c) the first compartment and the second compartment being within the artificial surface;

d) a filler being contained within the first compartment and within the second compartment;

e) a valve means communicating with the first compartment and the second compartment;

f) a means for positioning the filler within the first compartment and the second compartment in order to form the artificial surface; and g) the valve means further including means to receive a vacuum pump.

13. The artificial surface of claim 12 further comprising the artificial surface being adapted for use as a golf course.

14. The artificial surface of claim 12 further comprising the artificial surface being adapted for use as a miniature golf course.

15. The artificial surface of claim 12 further comprising:

a) a first edge of the first sheet of material being secured to a second edge of the second sheet of material to form the compartment being secured having a turf-like surface; and b) the artificial surface being adapted for use as a football field.

16. The artificial surface of claim 12 further comprising:

a) a first edge of the first sheet of material being secured to a second edge of the second sheet of material to form the compartment; and b) the artificial surface being adapted for use as a soccer field.

17. The artificial surface of claim 12 further comprising the filler being glass beads.

* * * * *